US010431173B2

(12) United States Patent
Huang

(10) Patent No.: US 10,431,173 B2
(45) Date of Patent: Oct. 1, 2019

(54) DISPLAY APPARATUS, AND CIRCUIT AND METHOD FOR DRIVING DISPLAY APPARATUS

(71) Applicant: HKC Corporation Limited, Shenzhen, Guangdong (CN)

(72) Inventor: Beizhou Huang, Shenzhen (CN)

(73) Assignee: HKC CORPORATION LIMITED, Shenzhen, Guangdong (CN)

( * ) Notice: Subject to any disclaimer, the term of this patent is extended or adjusted under 35 U.S.C. 154(b) by 0 days.

(21) Appl. No.: 15/743,020

(22) PCT Filed: Dec. 21, 2017

(86) PCT No.: PCT/CN2017/117652

§ 371 (c)(1),
(2) Date: Jan. 9, 2018

(87) PCT Pub. No.: WO2019/080332

PCT Pub. Date: May 2, 2019

(65) Prior Publication Data

US 2019/0130855 A1 May 2, 2019

(30) Foreign Application Priority Data

Oct. 26, 2017 (CN) ..... 2017 1 1016862

(51) Int. Cl.
*G09G 3/36* (2006.01)

(52) U.S. Cl.
CPC ..... *G09G 3/3648* (2013.01); *G09G 3/3607* (2013.01)

(58) Field of Classification Search
CPC ..... G09G 3/3648; G09G 3/3607
See application file for complete search history.

(56) References Cited

U.S. PATENT DOCUMENTS

2008/0001895 A1* 1/2008 Choi ..... G09G 3/3648 345/98
2013/0257511 A1* 10/2013 Chen ..... G06F 1/28 327/377
2015/0187427 A1* 7/2015 Oh ..... G11C 16/22 345/212

FOREIGN PATENT DOCUMENTS

CN 1886771 A 12/2006
CN 201117293 Y 9/2008
(Continued)

OTHER PUBLICATIONS

International Search Report based on Application No. PCT/CN2017/117652; dated Jul. 20, 2018.

*Primary Examiner* — Abhishek Sarma
(74) *Attorney, Agent, or Firm* — Muncy, Geissler, Olds & Lowe, P.C.

(57) ABSTRACT

A drive circuit includes: a connection module, including a first and a second interfaces for receiving a control signal; an adjustment module, including: a first switch, a control end thereof is coupled to the first interface, a first end is coupled to a supply voltage, and a second end is coupled to a first resistor; second switch, a control end thereof is coupled to the second interface, a first end is coupled to a second resistor, and a second end is grounded; and a third resistor, coupled to the first and the second switches; and a write protection module coupled to the second end of the second switch, and including a software written and a write protection states, where the first and the second switches are controlled to be open or closed by using the control signal, to control the working states of the write protection module.

18 Claims, 6 Drawing Sheets

(56) References Cited

FOREIGN PATENT DOCUMENTS

| | | | |
|---|---|---|---|
| CN | 202930011 | U | 5/2013 |
| CN | 103578389 | A | 2/2014 |
| CN | 105632442 | A | 6/2016 |
| CN | 107103889 | A | 8/2017 |
| JP | H11344962 | A | 12/1999 |

* cited by examiner

DISPLAY APPARATUS, AND CIRCUIT AND METHOD FOR DRIVING DISPLAY APPARATUS

BACKGROUND

Technical Field

This application relates to the display field, and in particular, to a display apparatus, and a circuit and method for driving a display apparatus and having a write protection function.

Related Art

A thin film transistor display apparatus (TFT-LCD) is one of the main types of current flat-panel display apparatuses and has become an important display platform of modern IT and video products. A main principle for driving a TFT-LCD is that a system board connects an R/G/B compressed signal, a control signal and power to a connector on a printed circuit board (PCB) by using a wire. After data is processed by a timing control chip (TCON, Timing Controller) on the PCB, the data passes through the PCB and is connected to a display area by using a source drive chip (S-COF, Source-Chip on Film) and a gate drive chip (G-COF, Gate-Chip on Film), so that the display apparatus obtains a required power source and signals.

To avoid miswriting of software content to a chip on a PCB board during daily use, write protection is performed on the chip during normal application. However, during streamline production of a display apparatus, software needs to be written to a chip. In this case, a write protection setting of a chip needs to be released. In an existing design, a connector on a PCB board is connected to a streamline device, and write protection is controlled to be enabled and disabled by a high potential and a low potential of the streamline device. Due to limitations of streamline devices, some streamline devices are only capable of outputting high potentials or only capable of outputting low potentials, and cannot switch between a high potential and a low potential as required. That is, the streamline devices cannot enable or disable write protection of a chip as required.

SUMMARY

To resolve the foregoing technical problem, an objective of this application is to provide a display apparatus, and a circuit and method for driving a display apparatus and having a write protection function.

The objective of this application is achieved and the technical problem of this application is resolved by using the following technical solutions. A circuit for driving a display apparatus provided in this application comprises: a connection module, comprising a first interface and a second interface, where the first interface and the second interface are configured to receive a control signal; an adjustment module, comprising: a first switch, where a control end of the first switch is coupled to the first interface, a first end is coupled to a supply voltage, and a second end is coupled to a first resistor, where the first resistor is grounded; a second switch, where a control end of the second switch is coupled to the second interface, a first end is coupled to a second resistor, and a second end is grounded, where the second resistor is coupled to the supply voltage; and a third resistor, where one end of the third resistor is coupled to the second end of the first switch, and another end is coupled to the control end of the second switch; and a write protection module, where the write protection module is coupled to the second end of the second switch, and the write protection module comprises two working states: a software written state and a write protection state, where the first switch and the second switch in the adjustment module are controlled to be open or closed by using the control signal received by the first interface or the second interface, to control the working states of the write protection module.

In an embodiment of this application, the control signal comprises a first control signal and a second control signal. The first control signal is at a high potential, and the second control signal is at a low potential. The supply voltage is 3.3 V, the high potential is 3.3 V, and the low potential is 0 V.

In an embodiment of this application, when the control signal is the first control signal, the second interface is connected to the first control signal, and the first interface is not connected, where the second interface receives or rejects to receive the first control signal.

In an embodiment of this application, the second interface receives the first control signal, and the second switch is open. The write protection module is grounded by using the first end and the second end of the second switch and enters the software written state.

In an embodiment of this application, the second interface rejects to receive the first control signal, and the second switch is closed. The write protection module is coupled to the supply voltage by using the second resistor and enters the write protection state.

In an embodiment of this application, when the control signal is the second control signal, the first interface is connected to the second control signal, and the second interface is not connected, where the first interface receives or rejects to receive the second control signal.

In an embodiment of this application, the first interface receives the second control signal, and the first switch and the second switch are open. The write protection module is grounded and enters the software written state.

In an embodiment of this application, the first interface rejects to receive the second control signal, and the first switch and the second switch are closed. The write protection module is coupled to the supply voltage by using the second resistor and enters the write protection state.

In an embodiment of this application, the first switch is a hole-type transistor, and the second switch is an electron-type transistor.

Further, the objective of this application may be achieved and the technical problem of this application may be resolved by using the following technical solutions.

Another objective of this application is to provide a method for driving a display apparatus, comprising: when a control signal is a first control signal at a high potential, the first control signal is coupled to a second interface, where the second interface receives or rejects to receive the first control signal; and when the second interface receives the first control signal, a second switch between the second interface and a write protection module is open, and the write protection module is grounded and enters a software written state; or when the second interface rejects to receive the first control signal, the second switch between the second interface and the write protection module is closed, and the write protection module is coupled to a supply voltage and enters a write protection state. When the control signal is a second control signal at a low potential, the second control signal is coupled to a first interface, where the first interface receives or rejects to receive the second control signal; and when the first interface receives the second control signal, a first switch between the first interface and the write protection module and the second switch are open, and the write protection module is grounded and enters a software written state; or when the first interface rejects to receive the second control signal, the first switch between the first interface and the write protection module and the second switch are closed, and the write protection module is coupled to a supply voltage and enters a write protection state.

Still another objective of this application is to provide a display apparatus, comprising a display panel and a drive circuit, where the drive circuit comprises: a connection module, comprising a first interface and a second interface; an adjustment module, comprising: a first switch, where a control end of the first switch is coupled to the first interface, a first end is coupled to a supply voltage, and a second end is coupled to a first resistor, where the first switch is a hole-type transistor, and the first resistor is grounded; a second switch, where a control end of the second switch is coupled to the second interface, a first end is coupled to a second resistor, and a second end is grounded, where the second switch is an electron-type transistor, and the second resistor is coupled to the supply voltage; and a third resistor, where one end of the third resistor is coupled to the second end of the first switch, and another end is coupled to the control end of the second switch; and a write protection module, where the write protection module is coupled to the second end of the second switch, and the write protection module comprises two working states: a software written state and a write protection state. The first switch and the second switch in the adjustment module are controlled to be open or closed by using a control signal received by the first interface or the second interface, to control the working states of the write protection module. The control signal comprises a first control signal and a second control signal, the first control signal is at a high potential, and the second control signal is at a low potential. When the control signal is the first control signal, the second interface is connected to the first control signal, and the first interface is not connected, the second interface receives the first control signal, and the second switch is open, the write protection module is grounded by using the first end and the second end of the second switch and enters the software written state; or the second interface rejects to receive the first control signal, and the second switch is closed, and the write protection module is coupled to the supply voltage by using the second resistor and enters the write protection state. When the control signal is the second control signal, the first interface is connected to the second control signal, and the second interface is not connected, the first interface receives the second control signal, and the first switch and the second switch are open, the write protection module is grounded and enters the software written state; or the first interface rejects to receive the second control signal, and the first switch and the second switch are closed, and the write protection module is coupled to the supply voltage by using the second resistor and enters the write protection state.

In this application, by designing the write protection module and the circuit of the display apparatus, both a streamline device only capable of outputting a high potential and a streamline device only capable of outputting a low potential can implement a write protection function for the display apparatus. Therefore, this design improves compatibility of the display apparatus and can lower reconstruction costs of the streamline devices.

DETAILED DESCRIPTION

The following embodiments are described with reference to the accompanying drawings, which are used to exemplify specific embodiments for implementation of this application. Terms about directions mentioned in this application, such as "on", "below", "front", "back", "left", "right", "in", "out", and "side surface" merely refer to directions in the accompanying drawings. Therefore, the used terms about directions are used to describe and understand this application, and are not intended to limit this application.

The accompanying drawings and the description are considered to be essentially exemplary, rather than limitative. In the figures, units with similar structures are represented by using the same reference number. In addition, for understanding and ease of description, the size and the thickness of each component shown in the accompanying drawings are arbitrarily shown, but this application is not limited thereto.

In addition, in this specification, unless otherwise explicitly described to have an opposite meaning, the word "include" is understood as including the component, but not excluding any other component. In addition, in this specification, "on" means that a component is located on or below a target component, but does not mean that the component needs to be located on top of the gravity direction.

To further describe the technical means adopted in this application to achieve the intended application objective and effects thereof, specific implementations, structures, features, and effects of a display apparatus, and a circuit and method for driving a display apparatus provided according to this application are described below in detail with reference to the drawings and preferred embodiments.

Figure 1:
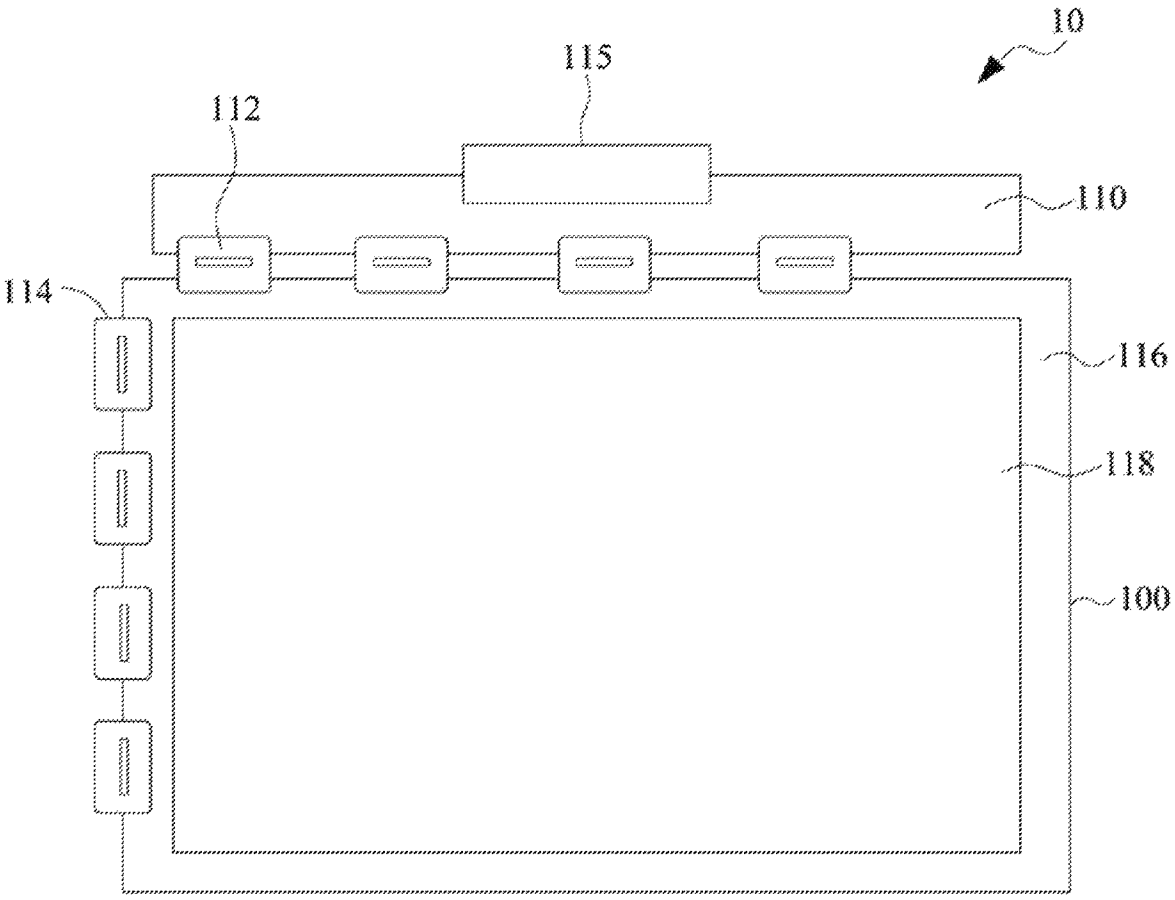
FIG. 1 is a schematic diagram of an exemplary display apparatus.

FIG. 1 is a schematic diagram of an exemplary display apparatus. Referring to FIG. 1, the exemplary display apparatus 10 includes: a PCB board 110, including a connector 115, where the connector 115 is configured to connect to a streamline device 24; a display panel 100, where the display panel 100 includes a display area 118 and a wiring area 116; and a plurality of source drive chips 112 and a plurality of gate drive chips 114 disposed relative to the wiring area 116 of the display panel 100. During streamlining of the display apparatus, the streamline device is connected to the connector 115 on the PCB board 110, and a high potential and a low potential is output to the display apparatus 10 by using the streamline device, thereby writing software to the PCB board 110. However, some streamline devices are only capable of outputting either of high potentials and low potentials, and cannot satisfy a software written requirement. If a streamline device is upgraded or reconstructed, quite large costs are caused.

Figure 2:
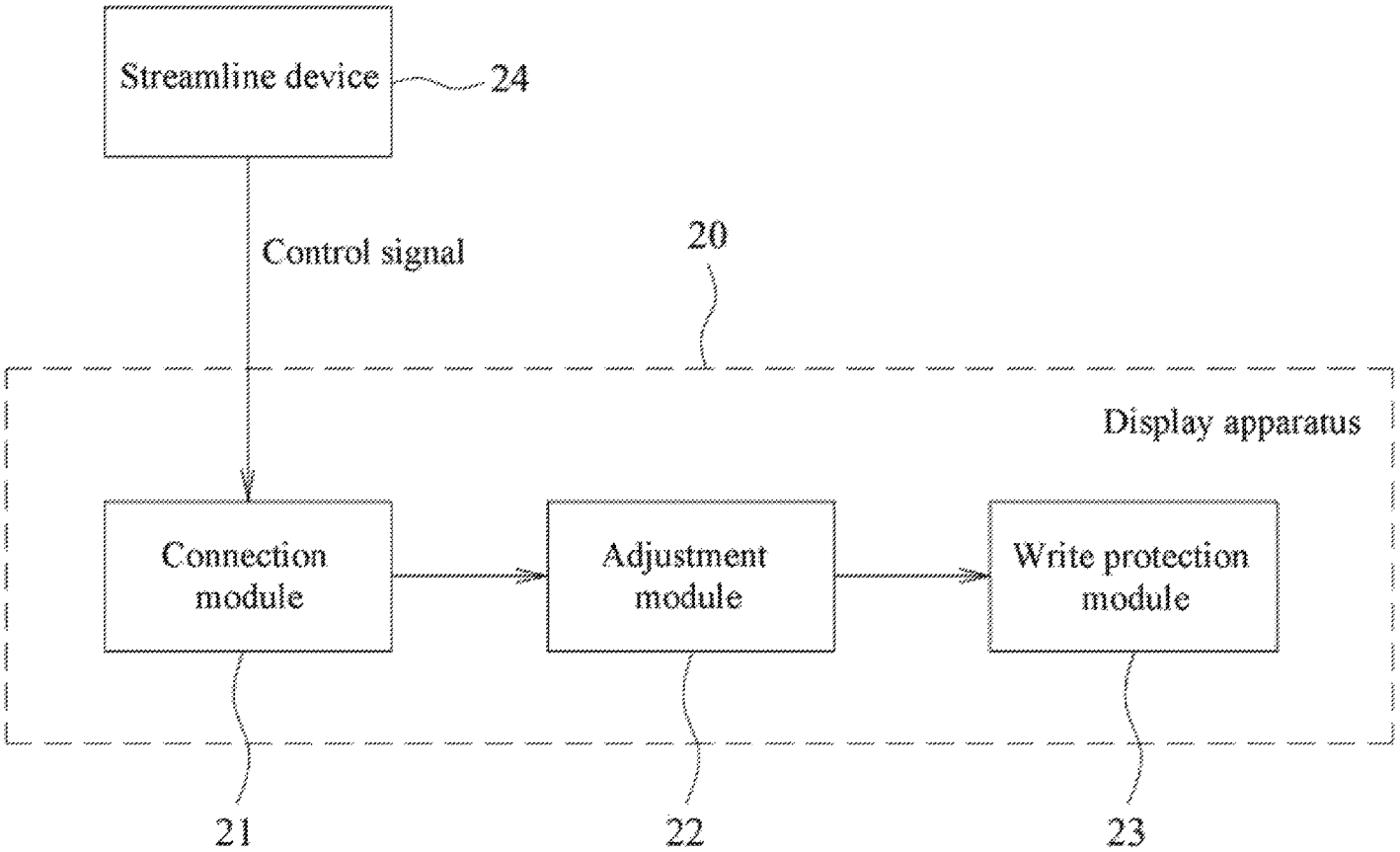
FIG. 2 is a block diagram of a display apparatus according to an embodiment of this application.
Figure 3:
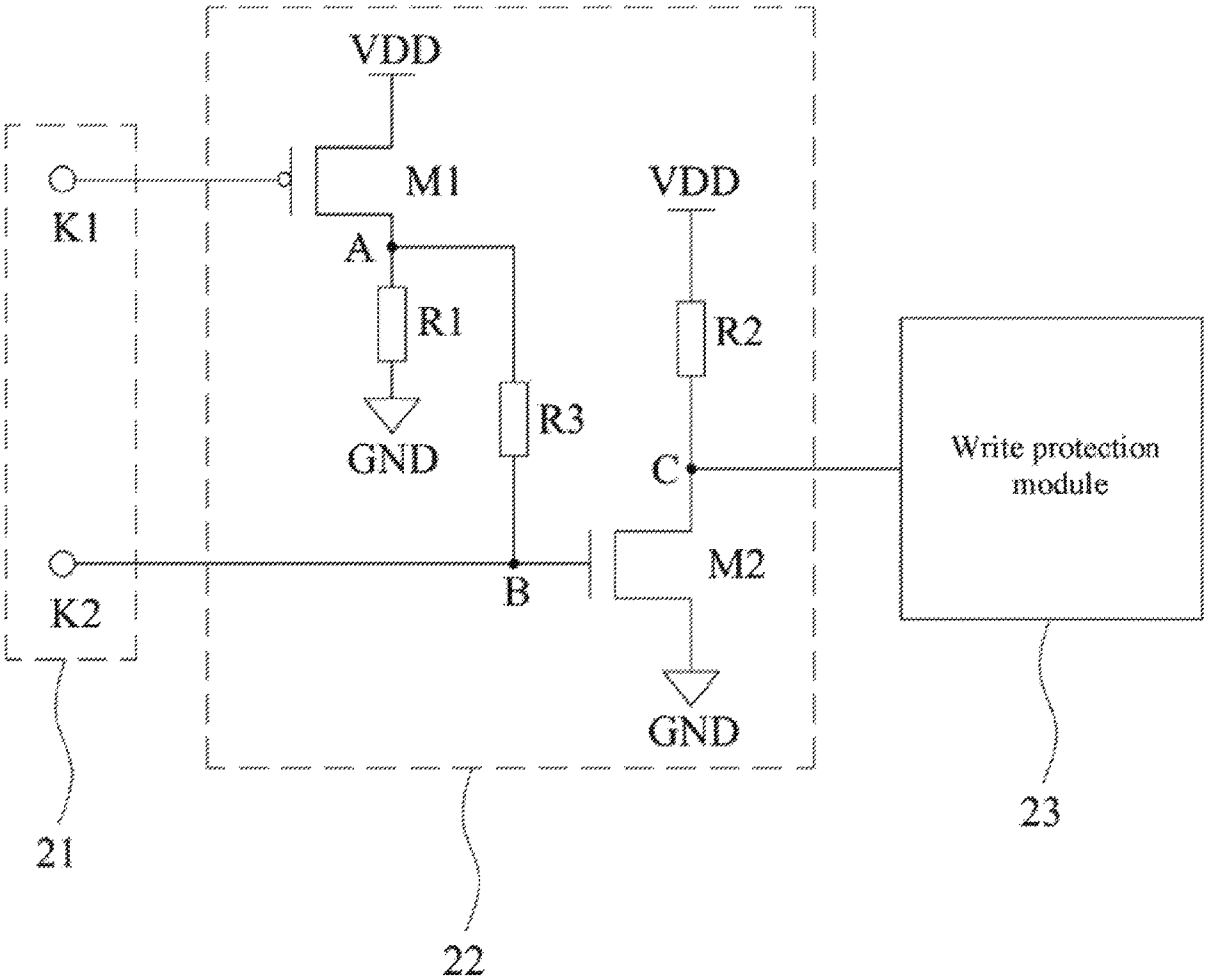
FIG. 3 is a schematic diagram of a drive circuit according to an embodiment of this application.
Figure 4A:
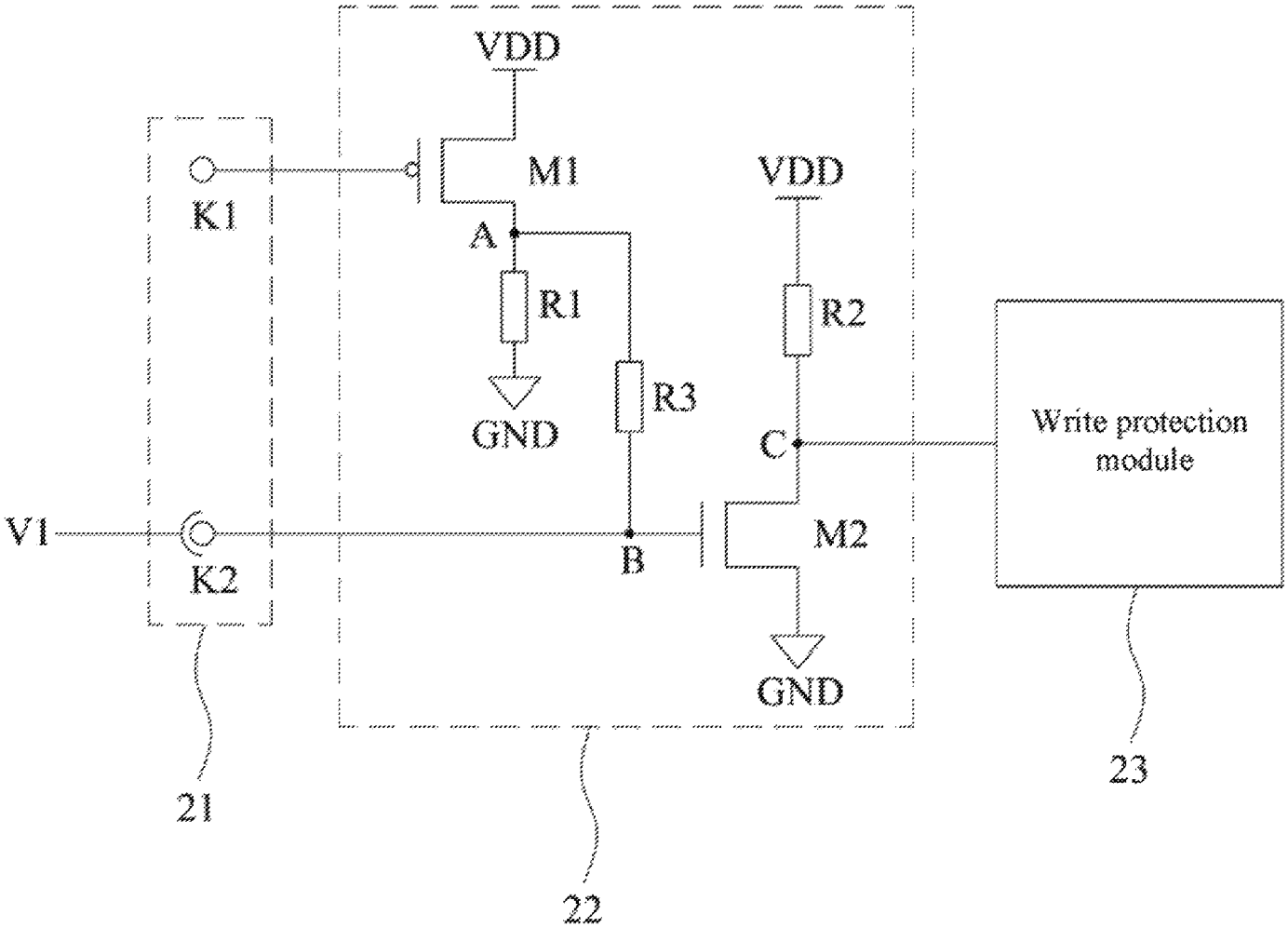
FIG. 4*a* is a schematic diagram of connection of a drive circuit according to an embodiment of this application.
Figure 4B:
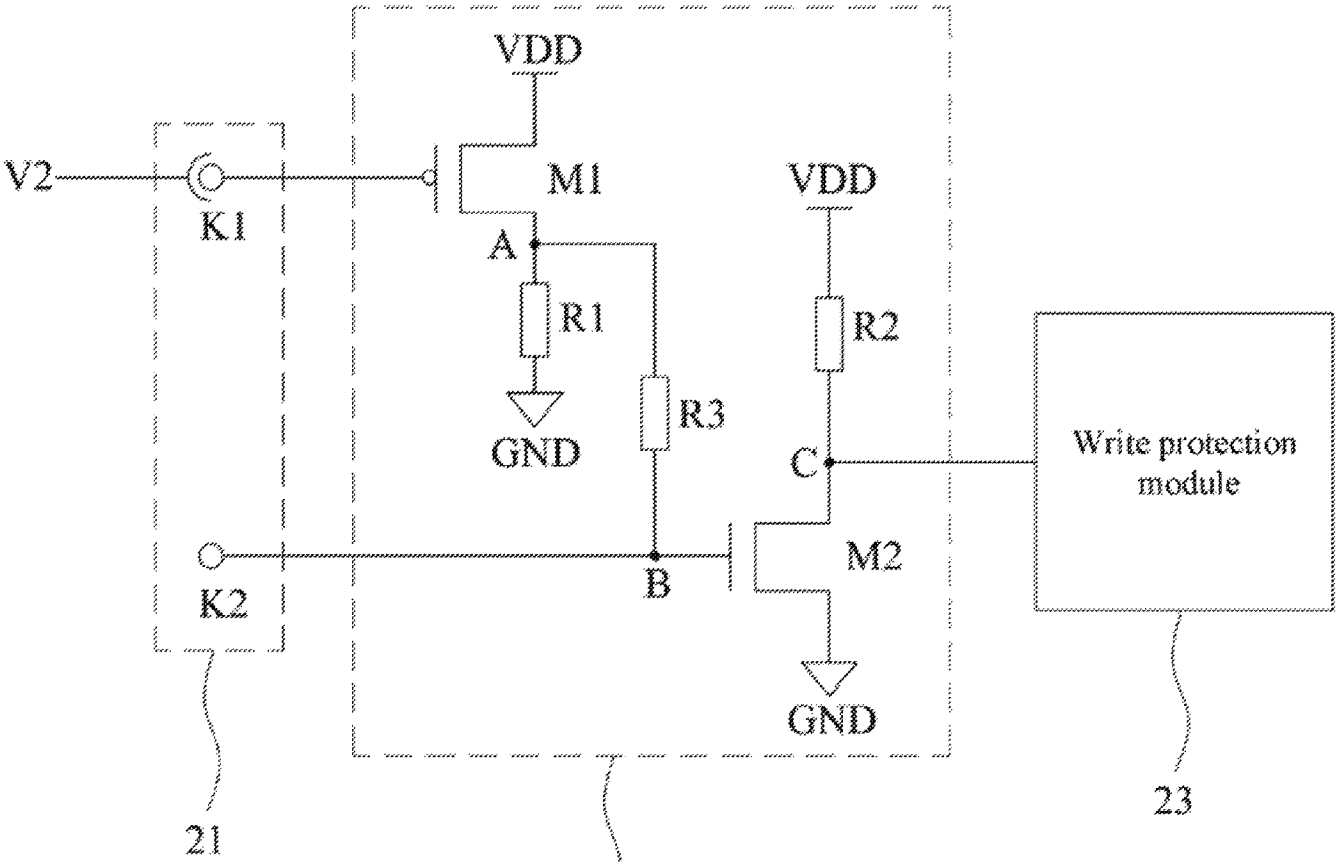
FIG. 4*b* is a schematic diagram of connection of a drive circuit according to another embodiment of this application.

FIG. 2 is a block diagram of a display apparatus according to an embodiment of this application, FIG. 3 is a schematic diagram of a drive circuit according to an embodiment of this application, FIG. 4*a* is a schematic diagram of connection of a drive circuit according to an embodiment of this application, and FIG. 4*b* is a schematic diagram of connection of a drive circuit according to another embodiment of this application. Referring to FIG. 2 to FIG. 4*b*, in an embodiment of this application, a circuit for driving a display apparatus 20 and having a write protection function includes: a connection module 21, including a first interface K1 and a second interface K2, where the first interface K1 and the second interface K2 are configured to receive a control signal; an adjustment module 22, including: a first switch M1, where a control end of the first switch M1 is coupled to the first interface K1, a first end is coupled to a supply voltage VDD, and a second end is coupled to a first resistor R1, where the first resistor R1 is grounded GND; a second switch M2, where a control end of the second switch M2 is coupled to the second interface K2, a first end is coupled to a second resistor R2, and a second end is grounded GND, where the second resistor R2 is coupled to the supply voltage VDD; and a third resistor R3, where one end of the third resistor R3 is coupled to the second end of the first switch M1, and another end is coupled to the control end of the second switch M2; and a write protection module 23, where the write protection module 23 is coupled to the second end of the second switch M2, and the write protection module 23 includes two working states: a software written state and a write protection state. The first switch M1 and the second switch M2 in the adjustment module 22 are controlled to be open or closed by using a control signal (V1, V2) received by the first interface K1 or the second interface K2, to control the working states of the write protection module 23.

In an embodiment of this application, the control signal is provided by a streamline device 24. The streamline device 24 can write software to a chip on the PCB board. The control signal includes a first control signal V1 and a second control signal V2. The first control signal V1 is at a high potential, and the second control signal V2 is at a low potential.

In an embodiment of this application, the supply voltage VDD and the high potential may be, for example, 3.3 V. Being grounded GND is equivalent to being at a low potential, and the low potential is 0 V.

In an embodiment of this application, when a potential at a point C is a high potential, the write protection module 23 enters the write protection state, so that the write protection function is enabled to prohibit the streamline device 24 from writing software. When the potential at point C is a low potential, the write protection module 23 enters the software written state, so that the write protection function is disabled to allow the streamline device 24 to write software.

In an embodiment of this application, the first switch M1 is a hole-type transistor, that is, a P-type transistor, and the second switch M2 is an electron-type transistor, that is, an N-type transistor.

In an embodiment of this application, when the control signal is the first control signal V1, the second interface K2 is connected to the first control signal V1, and the first interface K1 is not connected (as shown in FIG. 4*a*). The second interface K2 may receive or reject to receive the first control signal V1.

In an embodiment of this application, the second interface K2 receives the first control signal V1. A point B is at a high potential, and the second switch M2 is open. The write protection module 23 is grounded GND by using the first end and the second end of the second switch M2. A point C is at a low potential, and the write protection module 23 enters the software written state.

In an embodiment of this application, the second interface K2 rejects to receive the first control signal V1, and the second switch M2 is closed. The write protection module 23 is coupled to the supply voltage VDD by using the second resistor R2. A point C is at a high potential, and the write protection module 23 enters the write protection state.

In an embodiment of this application, when the control signal is the second control signal V2, the first interface K1 is connected to the second control signal V2, and the second interface K2 is not connected (as shown in FIG. 4*b*). The first interface K1 may receive or reject to receive the second control signal V2.

In an embodiment of this application, the first interface K1 receives the second control signal V2, the first switch M1 is open, the supply voltage VDD is conducted to the control end of the second switch M2 by using the first end and the second end of the first switch M1, so that both a point A and the point B are at high potentials, the second switch M2 is open, the write protection module 23 is grounded GND, the point C is at a low potential, and the write protection module 23 enters the software written state.

In an embodiment of this application, the first interface K1 rejects to receive the second control signal V2, the first switch M1 is closed, both the point A and the point B are at low potentials. The second switch M2 is closed. The write protection module 23 is coupled to the supply voltage VDD by using the second resistor R2. The point C is at a high potential, and the write protection module 23 enters the write protection state.

In some embodiments, the first resistor R1, the second resistor R2, and the third resistor R3 may be, for example, 10 KΩ.

In some embodiments, the first interface K1 or the second interface K2 rejects to receive the control signal (V1, V2). This may also be equivalent to that the streamline device 24 controls the first control signal V1 or the second control signal V2 not to output any data. In this way, the streamline device 24 may be controlled by using only a control signal at a high potential or a low potential to write or reject to write software to the display apparatus 20.

Figure 5:
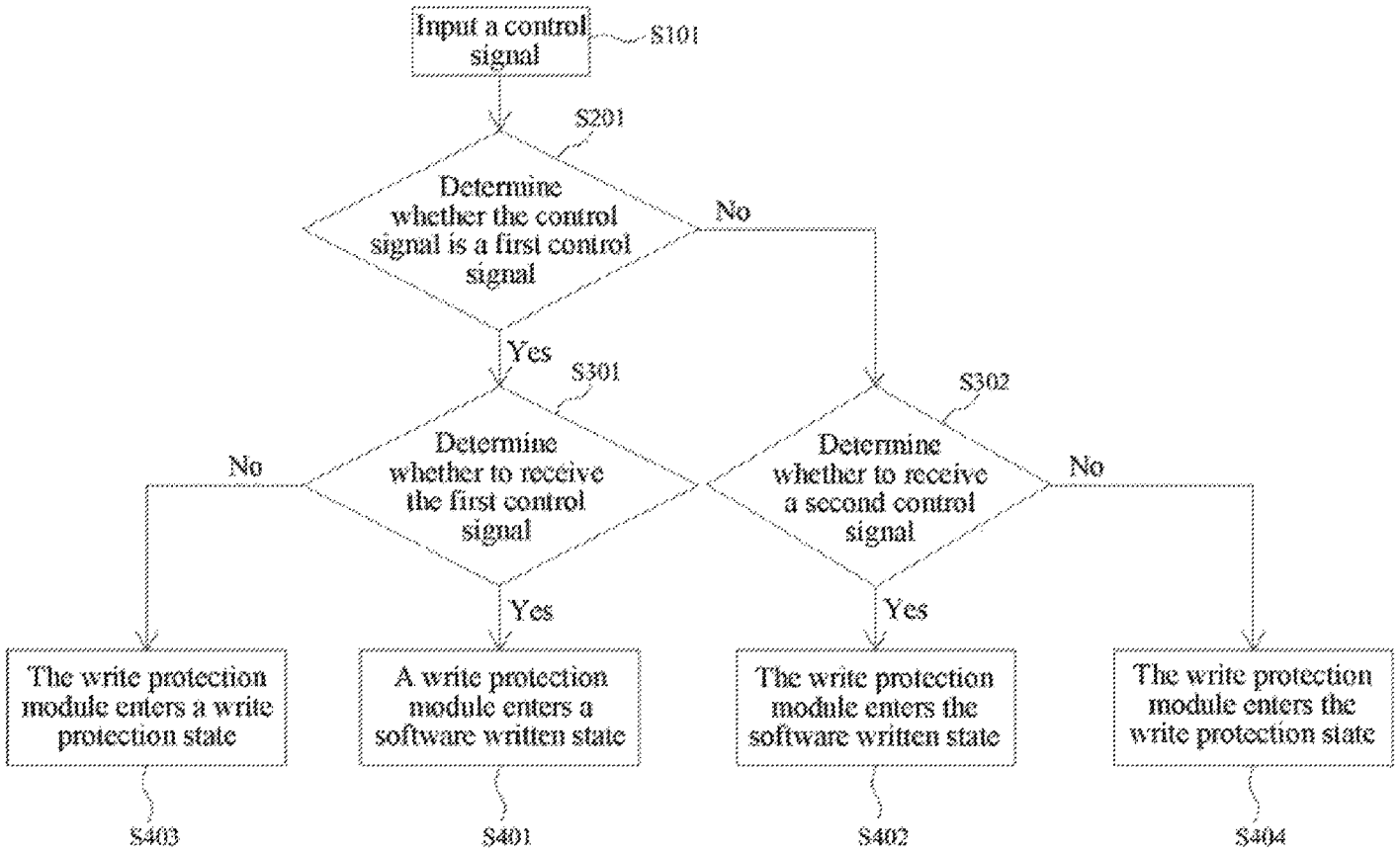
FIG. 5 is a flowchart of a method for driving a display apparatus according to an embodiment of this application.

FIG. 5 is a flowchart of a method for driving a display apparatus according to an embodiment of this application. Further, referring to FIG. 2 to FIG. 5, in an embodiment of this application, a method for driving a display apparatus 20 and having a write protection function includes: when a control signal is a first control signal V1 at a high potential, the first control signal V1 is coupled to a second interface K2. The second interface K2 may receive or reject to receive the first control signal V1. When the second interface K2 receives the first control signal V1, a second switch M2 between the second interface K2 and the write protection module 23 is open, and the write protection module 23 is grounded GND and enters the software written state. When the second interface K2 rejects to receive the first control signal V1, the second switch M2 between the second interface K2 and the write protection module 23 is closed, and the write protection module 23 is coupled to a supply voltage VDD and enters a write protection state. When the control signal is a second control signal V2 at a low potential, the second control signal V2 is coupled to a first interface K1. The first interface K1 may receive or reject to receive the second control signal. When the first interface K1 receives the second control signal V2, a first switch M1 between the first interface K1 and the write protection module 23 and the second switch M2 are open, and the write protection module 23 is grounded GND and enters a software written state. When the first interface K1 rejects to receive the second control signal V2, the first switch M1 between the first interface K1 and the write protection module 23 and the second switch M2 are closed, and the write protection module 23 is coupled to a supply voltage VDD and enters a write protection state.

Referring to FIG. 5, the method for driving a display apparatus and having a write protection function has the following steps:

Step S101: Input a control signal.

Step S201: Determine whether the control signal is a first control signal. If the control signal is the first control signal, step S301 is performed; or if the control signal is not the first control signal, step S302 is performed.

Step S301: Determine whether to receive the first control signal. If it is determined to receive the first control signal, step S401 is performed; or if it is determined not to receive the first control signal, step S403 is performed.

Step S401: A write protection module enters a software written state.

Step S403: The write protection module enters a write protection state.

When the control signal is a second control signal and not the first control signal, the following steps are performed:

Step S302: Determine whether to receive the second control signal. If it is determined to receive the second control signal, step S402 is performed; or if it is determined not to receive the second control signal, step S404 is performed.

Step S402: The write protection module enters the software written state.

Step S404: The write protection module enters the write protection state.

In this application, by designing the write protection module and the circuit of the display apparatus 20, both a streamline device 24 only capable of outputting a high potential and a streamline device 24 only capable of outputting a low potential can implement a write protection function for the display apparatus 20. Therefore, this design improves compatibility of both the display apparatus 20 and streamline production of the display apparatus 20, and can lower reconstruction costs of the streamline devices 24.

Referring to FIG. 2 to FIG. 4*b*, in an embodiment of this application, a display apparatus includes: a display panel and the circuit for driving a display apparatus in the foregoing embodiments.

The terms such as "in some embodiments" and "in various embodiments" are repeatedly used. The wordings usually refer to different embodiments, but they may also refer to a same embodiment. The terms such as "comprising", "having" and "including" are synonyms, unless other meanings are indicated in the context.

The foregoing descriptions are merely embodiments of this application, and are not intended to limit this application in any form. Although this application has been disclosed above through the specific embodiments, the embodiments are not intended to limit this application. Any person skilled in the art can make some variations or modifications, which are equivalent changes, according to the foregoing disclosed technical content to obtain equivalent embodiments without departing from the scope of the technical solutions of this application. Any simple amendment, equivalent change, or modification made to the foregoing embodiments according to the technical essence of this application without departing from the content of the technical solutions of this application shall fall within the scope of the technical solutions of this application.

What is claimed is:

1. A display apparatus, comprising a display panel and a drive circuit, wherein the drive circuit comprises:

a connection module, comprising a first interface and a second interface;

an adjustment module, comprising:

a first switch, wherein a control end of the first switch is coupled to the first interface, a first end is coupled to a supply voltage, and a second end is coupled to a first resistor, wherein the first switch is a hole-type transistor, and the first resistor is grounded;

a second switch, wherein a control end of the second switch is coupled to the second interface, a first end is coupled to a second resistor, and a second end is grounded, wherein the second switch is an electron-type transistor, and the second resistor is coupled to the supply voltage; and a third resistor, wherein one end of the third resistor is coupled to the second end of the first switch, and another end is coupled to the control end of the second switch;

wherein the first switch and the second switch in the adjustment module are controlled to be open or closed by using a control signal received by the first interface or the second interface, to control a software written state or a write protection state, wherein the control signal comprises a first control signal and a second control signal, the first control signal is at a high potential, and the second control signal is at a low potential;

when the control signal is the first control signal, the second interface is connected to the first control signal, and the first interface is not connected, the second interface receives the first control signal, and the second switch is open, the first end and the second end of the second switch are grounded to enter the software written state; or the second interface rejects to receive the first control signal, and the second switch is closed, and the supply voltage is coupled by using the second resistor to enter the write protection state; or when the control signal is the second control signal, the first interface is connected to the second control signal, and the second interface is not connected, the first interface receives the second control signal, and the first switch and the second switch are open to enter the software written state; or the first interface rejects to receive the second control signal, and the first switch and the second switch are closed, and the supply voltage is coupled by using the second resistor to enter the write protection state.

2. A circuit for driving a display apparatus, comprising:

a connection module, comprising a first interface and a second interface;

an adjustment module, comprising:

a first switch, wherein a control end of the first switch is coupled to the first interface, a first end is coupled to a supply voltage, and a second end is coupled to a first resistor, wherein the first resistor is grounded;

a second switch, wherein a control end of the second switch is coupled to the second interface, a first end is coupled to a second resistor, and a second end is grounded, wherein the second resistor is coupled to the supply voltage; and a third resistor, wherein one end of the third resistor is coupled to the second end of the first switch, and another end is coupled to the control end of the second switch;

wherein the first switch and the second switch in the adjustment module are controlled to be open or closed by using a control signal received by the first interface or the second interface, to control a software written state or a write protection state.

3. The circuit for driving a display apparatus according to claim 2, wherein the control signal comprises a first control signal and a second control signal.

4. The circuit for driving a display apparatus according to claim 3, wherein the first control signal is at a high potential, and the second control signal is at a low potential.

5. The circuit for driving a display apparatus according to claim 4, wherein the supply voltage is 3.3 V, the high potential is 3.3 V, and the low potential is 0 V.

6. The circuit for driving a display apparatus according to claim 4, wherein when the control signal is the first control signal, the second interface is connected to the first control signal, and the first interface is not connected.

7. The circuit for driving a display apparatus according to claim 6, wherein the second interface receives or rejects to receive the first control signal.

8. The circuit for driving a display apparatus according to claim 7, wherein the second interface receives the first control signal, and the second switch is open.

9. The circuit for driving a display apparatus according to claim 8, wherein the first end and the second end of the second switch are grounded to enter the software written state.

10. The circuit for driving a display apparatus according to claim 7, wherein the second interface rejects to receive the first control signal, and the second switch is closed.

11. The circuit for driving a display apparatus according to claim 10, wherein the supply voltage is coupled by using the second resistor to enter the write protection state.

12. The circuit for driving a display apparatus according to claim 4, wherein when the control signal is the second control signal, the first interface is connected to the second control signal, and the second interface is not connected.

13. The circuit for driving a display apparatus according to claim 12, wherein the first interface receives or rejects to receive the second control signal.

14. The circuit for driving a display apparatus according to claim 13, wherein the first interface receives the second control signal, and the first switch and the second switch are open to enter the software written state.

15. The circuit for driving a display apparatus according to claim 13, wherein the first interface rejects to receive the second control signal, and the first switch and the second switch are closed.

16. The circuit for driving a display apparatus according to claim 15, wherein the supply voltage is coupled by using the second resistor to enter the write protection state.

17. The circuit for driving a display apparatus according to claim 2, wherein the first switch is a hole-type transistor.

18. The circuit for driving a display apparatus according to claim 2, wherein the second switch is an electron-type transistor.

* * * * *